US007677172B2

(12) United States Patent
Faber

(10) Patent No.: US 7,677,172 B2
(45) **Date of Patent: *Mar. 16, 2010**

(54) INK PAD CONTAINER FOR A SELF-INKING STAMP

(75) Inventor: Ernst Faber, Wels (AT)

(73) Assignee: Colop Stempelerzeugung Skopek Gesellschaft m.b.H. & Co. KG., Wels (AT)

( * ) Notice: Subject to any disclaimer, the term of this patent is extended or adjusted under 35 U.S.C. 154(b) by 0 days.

This patent is subject to a terminal disclaimer.

(21) Appl. No.: 12/074,585

(22) Filed: Mar. 5, 2008

(65) Prior Publication Data

US 2008/0148975 A1 Jun. 26, 2008

Related U.S. Application Data

(62) Division of application No. 10/548,314, filed on Sep. 7, 2005, now Pat. No. 7,389,727.

(30) Foreign Application Priority Data

Mar. 18, 2003 (AT) ..... GM184/2003

(51) Int. Cl.
*B41K 1/40* (2006.01)

(52) U.S. Cl. ..... 101/333; 101/334; 101/104; 118/264

(58) Field of Classification Search ..... 101/327, 101/333, 334, 405, 406, 103, 104; 118/264, 118/269

See application file for complete search history.

(56) References Cited

U.S. PATENT DOCUMENTS

| | | | | |
|---|---|---|---|---|
| 454,499 | A | 6/1891 | Ryer | 101/334 |
| 1,085,489 | A | 1/1914 | Rushworth | 101/334 |
| 1,508,598 | A | 9/1924 | Edgarton | 101/104 |
| 2,314,828 | A | 3/1943 | Humphries | 101/334 |
| RE24,029 | E | 6/1955 | Garvey | 118/264 |
| 4,823,696 | A | 4/1989 | Skopek | 101/334 |
| 5,517,916 | A | 5/1996 | Dour et al. | 101/334 |
| 6,796,230 | B2 | 9/2004 | Pichler et al. | 101/334 |
| 6,813,999 | B2 | 11/2004 | Treml | 101/104 |
| 6,877,426 | B1 | 4/2005 | Huang | 101/334 |

(Continued)

FOREIGN PATENT DOCUMENTS

| | | |
|---|---|---|
| AT | 383 993 | 9/1987 |

(Continued)

OTHER PUBLICATIONS

International Search Report of PCT/AT2004/000094.

*Primary Examiner*—Leslie J Evanisko
(74) *Attorney, Agent, or Firm*—Collard & Roe, P.C.

(57) ABSTRACT

An ink pad container for a self-inking stamp that is filled with ink by the top thereof at a pressure. The stamp has a housing and a stamping unit which is connected to an actuating element, movably arranged in the housing and provided with stamping characters. The ink pad container has a bottom and side walls projecting away therefrom. In use, horizontally arranged recesses are provided along a length of two lateral opposite side walls of the ink pad container and cooperate with continuous guiding and centering projections in an insertion compartment of the self-inking stamp to define precise guiding and centering of the ink pad container during its insertion.

4 Claims, 8 Drawing Sheets

U.S. PATENT DOCUMENTS

| | | | | |
|---|---|---|---|---|
| 6,892,637 | B2 | 5/2005 | Petersen | 101/333 |
| 7,069,852 | B2 | 7/2006 | Zindl et al. | 101/334 |
| 7,086,331 | B2 | 8/2006 | Moody | 101/334 |

FOREIGN PATENT DOCUMENTS

| | | | |
|---|---|---|---|
| AT | 4535 | | 8/2001 |
| EP | 0 438 067 | | 7/1991 |
| GB | 2 226 985 | | 7/1990 |
| WO | WO 01/83228 | | 11/2001 |
| WO | WO 01/85462 | | 11/2001 |
| WO | WO 0183227 | A1 * | 11/2001 |
| WO | WO 02/058939 | | 8/2002 |
| WO | WO 03/099572 | | 12/2003 |

* cited by examiner

INK PAD CONTAINER FOR A SELF-INKING STAMP

CROSS-REFERENCE TO RELATED APPLICATIONS

This is a divisional of U.S. patent application Ser. No. 10/548,314, filed on Sep. 7, 2005 now U.S. Pat. No. 7,389,727 patented Jun. 24, 2008. This application also claims priority under 35 U.S.C. §365 of PCT/AT2004/000094, filed on Mar. 16, 2004. The international application under PCT article 21(2) was not published in English. This application also claims priority under 35 U.S.C. §119 of Austrian Application No. GM 184/2003, filed on Mar. 18, 2003.

BACKGROUND OF THE INVENTION

1. Field of the Invention

The invention relates to an ink pad container and a self-inking stamp with upper inking. The stamp comprises a housing in which a stamp unit which is coupled with an actuating part and includes stamp characters is movably arranged and which has an insertion compartment with at least one insertion opening for the ink pad container, said insertion compartment having an opening at its lower side facing the stamp unit for inking of the stamp characters, when the latter are in their upper, turned position, by contacting the ink pad in said container.

2. The Prior Art

Many such self-inking stamps with upper inking in which an ink pad or a stamping pad container with the ink pad is inserted in a compartment in the housing in drawer-like manner are known, cf. e.g. U.S. Pat. No. 4,823,696 A or U.S. Pat. No. 5,517,916 A. What is important there is that the ink pad container is comparatively smooth-running when pulled out of their insertion compartment if stamping ink has to be refilled or if the container and its ink pad need to be exchanged, so that then the filled or a new container can be inserted again in smooth-running manner; however, the smooth-running guide nevertheless shall ensure a secure hold for the respective ink pad container in the inserted operating position so that, in the resting position of the self-inking stamp, the upwardly directed, ink-pad-contacting stamp characters will contact the former in the correct position and satisfactory inking thereof can be achieved.

On the other hand, it has already been known from AT 4535 U and WO 01/85 462 A, respectively, to provide a groove or, preferably, two grooves on the upper side of the ink pad container in the operating position (which is, on the upper side, i.e., outer side, of the bottom of the trough-shaped container) in which, when the container is inserted into the insertion compartment, one rib (each) provided on the upper side of the insertion compartment is positively engaged. This measure shall prevent the provision of non-fitting replacement ink pads in that the projecting ribs, if there are no corresponding grooves on the bottom of the ink pad container, constitute an obstacle when inserting the ink pad container. However, with these ribs that engage in the grooves, neither a smooth-running guidance of the ink-pad container in its insertion compartment, nor a secure, perfect hold of the ink pad container in its set position in the insertion compartment is achieved or assisted.

Furthermore, stamp designs of a different type, without an insertion compartment for the ink pad container have been suggested, in which a snap fit retention or press fit retention is provided for the ink pad on an upper part of a stamp, cf. e.g. WO 01/83 228 A, EP 438 067 A or GB 2 226 985 A. What is disadvantageous there is that an exchange of the ink pad, or of the ink pad container, respectively, is comparatively difficult to carry out.

SUMMARY OF THE INVENTION

It is now an object of the invention to provide a self-inking stamp of the initially defined type, in which a guidance of comparatively smooth running in the insertion compartment can be provided for the ink pad container during insertion thereof, wherein, nevertheless, a good, defined hold of the ink pad container in the correct position can be achieved in the insertion compartment.

The self-inking stamp according to the invention and of the initially defined type is characterized in that guiding and centering projections are provided for the ink pad container which are arranged on two opposite sides of the insertion compartment in the direction of insertion.

In this construction it suffices that in the region of the insertion compartment, the guiding and centering projections for the ink pad container are produced with as narrow tolerances as possible so as to ensure a precise guiding and centering effect during insertion of the ink pad container into the insertion compartment and an exact operating position of the ink pad container, and the remaining walls of the insertion compartment—insofar as they are present at all—may provide a comparatively loose guiding of the ink pad container.

Here, the guiding and centering projections may very well be each formed by a plurality of knobs or the like, i.e. by discontinuous projections, preferably, however, the desired guiding and centering effect is provided in that the guiding and centering projections are formed by ledges extending in the insertion direction. For an exact contact of the ink pad container and also for reasons of production it is furthermore suitable if the ledges are substantially rectangular, seen in front view.

As such, the ink-pad container may be substantially rectangular, having a plane bottom and plane walls which project away from the bottom, and in that case this ink pad container would contact the guiding and centering projections only in certain regions thereof with its walls or with its bottom, and otherwise, it would be present adjacent the guiding and centering projections, without abutting insertion compartment delimiting parts. In order to allow also in this instance an—although smooth-running—contact on other insertion compartment delimiting parts, it is furthermore advantageous if the ink pad container has lateral recesses cooperating with the guiding and centering projections.

For the desired centering effect it is particularly suitable if the recesses are provided on that rim of the ink pad container which is the lower rim in the inserted state of the ink pad container. Then, of course, also the guiding and centering projections will be provided on the lower rim of the insertion compartment in corresponding manner. Centering will then be effected as far outwards as possible and at a great distance from the retention element.

For a simple design of the recesses on the ink pad container it is suitable if the recesses on their side which is the upper side in the inserted state of the ink pad container are delimited by ledge projections on the side walls of the ink pad container.

With a view to the exact positioning of the ink pad container in the insertion compartment it is also particularly advantageous if at least one resilient retention element is arranged in the insertion compartment for resilient abutment on the ink pad container. With this design, the resilient retention element contacts the ink pad container, thereby preventing the ink pad container from unintentionally, accidentally sliding out of the insertion compartment, even if the container can be inserted in the insertion compartment in smooth-running manner. The resilient retention element may contact the ink pad container with a certain predetermined retention force so that, if desired, also a sufficiently tight contact of the ink pad container will be caused on the guiding and centering projections of the insertion compartment located opposite said retention element in the insertion compartment. In its inserted position, the ink pad container can assume an exact, defined position—with regard to pressing the stamp characters on, for the purpose of inking the same.

Even though the resilient retention element may also be arranged laterally in the insertion compartment, it is nevertheless suitable in terms of construction and also for reasons of a simple centering, if the resilient retention element is arranged on the upper side of the compartment, located opposite the opening provided on the lower side of the insertion compartment.

In order to make the movement for the ink pad container particularly smooth running and in order to provide an increased resistance only in the first and last phases of the insertion or removal of the ink pad container, it is advantageous if the resilient retention element is designed as a snap-in element for snapping engagement on the ink pad container. In this instance, the ink pad container may e.g. simply be provided with a peripherally raised rim on its bottom side which is the upper one in its inserted state, which raised rim will cause the aforementioned increased resistance during insertion and removal, and behind which the snap-in element will snap in during insertion. At the same time, this embodiment of the retention element as a snap-in element and the provision of corresponding snap-in depressions on the ink pad containers may also be employed to at least make the use of non-permitted, not-fitting ink pad containers more difficult.

In order to be able to overcome the resistance during insertion and removal, respectively, of the ink pad container more easily, the resilient retention element may have a preferably knob-shaped snap-in projection.

For a snap-in position that is defined as precisely as possible, it is, moreover, suitable if the ink pad container, preferably in its bottom area which is upwardly arranged in its inserted state, has a depression for snapping engagement of the resilient retention element. Here, it is furthermore advantageous if the depression is formed by a groove extending in the insertion direction of the ink pad container. It is also suitable if the groove-depression is delimited on both ends by an end wall. The groove or, generally expressed, the depression, may advantageously be provided centrally in the bottom of the ink pad container, and corresponding thereto, also the resilient retention, or snap-in element(s), respectively, is (are) provided centrally relative to the width of the insertion compartment, on the compartment upper side.

Particularly for functional reasons, advantageously two resilient retention elements may be arranged in successive alignment in the insertion direction of the ink pad container, it being furthermore suitable if the two resilient retention elements are tongue-shaped snap-in elements having one snap-in projection on each one of their free ends that face away from each other. These tongue-shaped snap-in elements then preferably cooperate with a central groove on the container upper side which, as has been mentioned, at both of its ends is delimited by an end wall so as to cause, by these end walls, the phase-wise resistance during insertion and removal, respectively, of the container.

Here, the ink pad container can be inserted into the insertion compartment with any one of its two broad sides ahead, from the one side of the insertion compartment, and, on the other hand, it may also be provided for the insertion compartment to have insertion openings on two opposite sides thereof so that the ink pad container can be inserted or also removed on both sides of the stamp.

When removing the ink pad container, the snap-in elements also have the effect that the push-out movement is assisted by the resilience of the resilient snap-in elements after the mentioned resistance has been overcome, wherein in the case of the particularly preferred embodiment with a groove that is delimited on both of its ends and with two resilient tongue-shaped snap-in elements it is achieved that in the course of pushing out, the snap in element which is located forward in the direction of pushing out, will brake the already largely pushed out ink pad container again in that the rear groove end wall which now has been moved towards the snap-in element comes to abut on this snap-in element; thereby the ink pad container is prevented from unintentionally "shooting out" too far.

The resilient resistance of the or each retention element can be achieved by an elastic design of the retention element itself, e.g. in the form of resilient tongues, as mentioned, yet the resilience may also be provided or assisted and increased in that the or each retention element is acted on by the force of a spring which presses the actuating part in a direction away from the housing. Therefore, if in this embodiment the (respective) retention element is to be moved in a direction away from the container, the force of the spring which acts on the actuating part becomes effective; in this embodiment, as a consequence of the elasticity of the material, the resilient design of the retention element—if provided at all—can be dimensioned to be weaker.

In corresponding manner, the invention also relates to an ink pad container to be used in a self-inking stamp according to the invention, wherein the ink pad container comprises a bottom and walls projecting therefrom, and wherein according to the invention lateral recesses are provided on two opposite side walls and cooperate with guiding and centering projections in the insertion compartment. Here, it is further advantageous if the recesses are provided on the rim of the side walls which faces away from the bottom. It is also suitable if the recesses on their side which is the upper side in the inserted state of the ink pad container are delimited by ledge projections on the side walls of the container.

It is also advantageous if the bottom is designed with a depression which, preferably, is provided in the middle thereof, for snapping engagement of a resilient retention element present in the insertion compartment of the self-inking stamp. As has already previously been mentioned, it may then be further provided that the depression is formed by a groove extending in the direction of insertion of the ink pad container; it is also suitable if the groove on both ends is delimited by an end wall.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
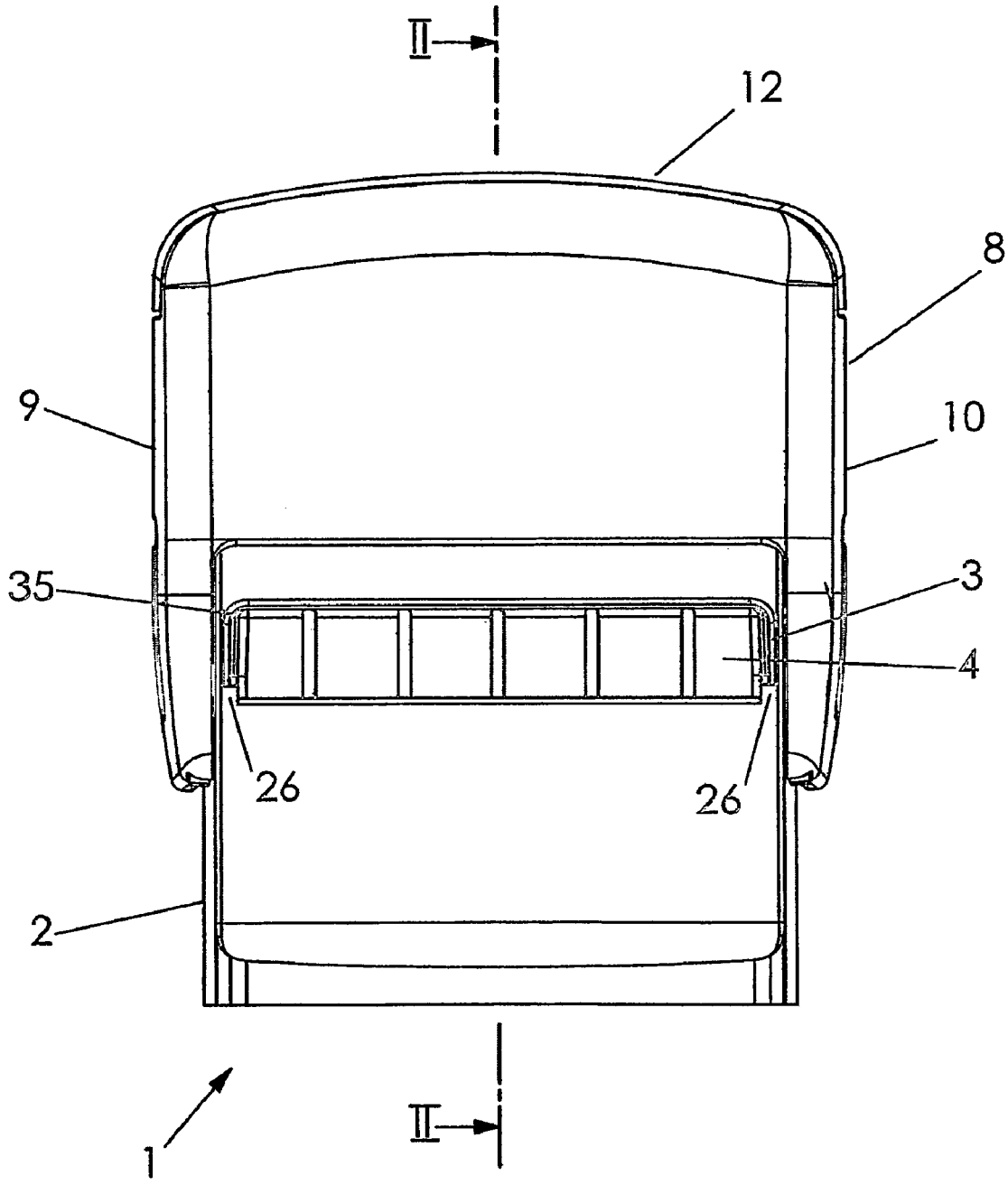
FIG. 1 shows a view of a self-inking stamp according to the invention.

The self-inking stamp 1 illustrated in FIGS. 1 to 6 comprises a stamp housing 2 called housing 2 in short hereinafter, in a per se conventional manner, which is frame-shaped and, on its upper side, has an insertion compartment 3 (cf. also FIGS. 3 to 5) for an ink pad container 4. As is visible in FIGS. 2 and 3, within the housing 2 there is a stamp unit 5 which, in a per se conventional manner, carries a stamp plate carrier 6 and, mounted thereon, a stamp plate 7 with stamp characters entered in FIG. 2 only. In this case, in FIG. 2 the stamp unit 5 is shown in its upper resting or inking position from which it can be converted, within the housing 2, into a lower operating or printing position turned by 180.degree., with the assistance of a bow-shaped actuating part 8 which has two lateral legs 9, 10 laterally guided on the housing 2. For this purpose, a conventional turning mechanism with curve control and slot guide only quite generally denoted by 11 in FIG. 2 is provided which, as such, is sufficiently known and, thus, does not require any further explanation here.

Figure 7:
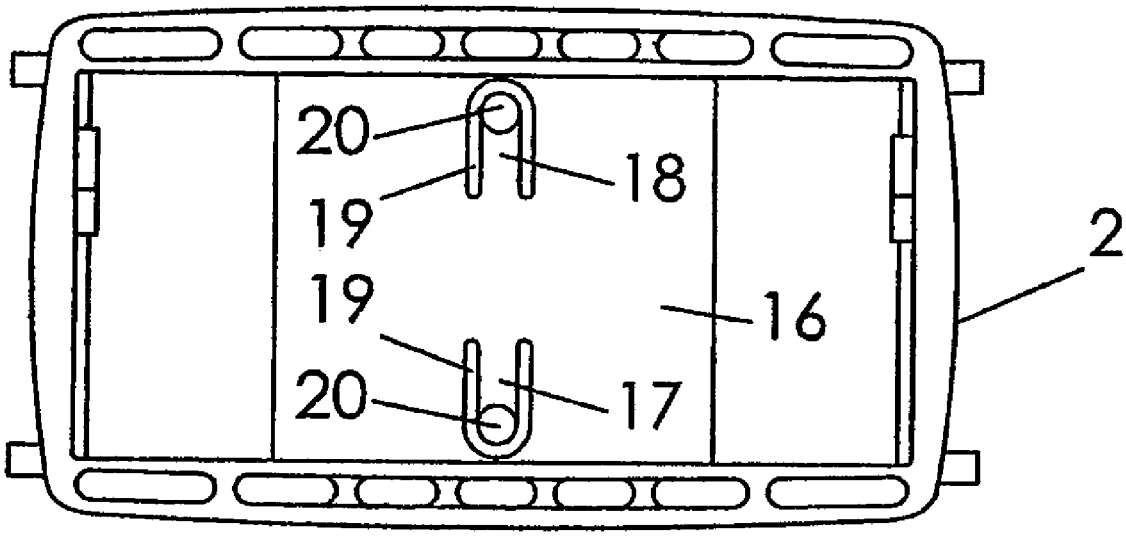
FIG. 7 shows a bottom view of the stamp housing with the stamp-unit removed and without an ink pad container, for illustrating the lower side of the wall which delimits the insertion compartment on the upper side thereof.

The bow-shaped actuating part 8 has a transparent or translucent inspection window 12 on its upper side, which inspection window covers an insertion compartment 13 for a paper insert reflecting the stamp imprint. Furthermore, the actuating part 8 is acted on in upward direction, i.e. away from housing 2, by a spring 14 provided as helical spring; here, the spring 14 is supported by the upper side of the housing 2 in the region of a cross-shaped guiding projection 15 on a middle wall 16 provided between two openings, which middle wall—partially—delimits the insertion compartment 3 on the upper side thereof, cf. also FIGS. 4 and 6. In this wall 16, two tongue-shaped retention or snap-in elements 17, 18, which are successively arranged in alignment in the insertion direction of the ink pad container 4, are kept clear by arcuate recesses, e.g. 19 (cf. FIG. 6), and on their lower side, these retention elements 17, 18 each have a knob-shaped, spherical snap-in projection 20 (cf. FIGS. 2, 5 and 7). In the state of the ink pad container 4 inserted in the insertion compartment 3, these knob-shaped snap-in projections 20 engage in an elongate, centrally arranged groove or, generally expressed, a depression 21 extending in insertion direction, which groove or, depression 21 extends on the upper side of the ink pad container 4, on its outer side in the bottom 22 thereof (cf. FIGS. 3 and 4). Otherwise, the ink pad container 4 is conventionally trough-shaped, with walls, e.g. 23, 24 (cf. FIG. 4) extending away from the bottom 22. In the operating or engagement position shown in FIGS. 2 and 3, the snap-in projections 20 on the snap or retention elements 17, 18 can contact the groove bottom by exerting a force thereon or also without any pressure, the latter being preferred.

Figure 2:
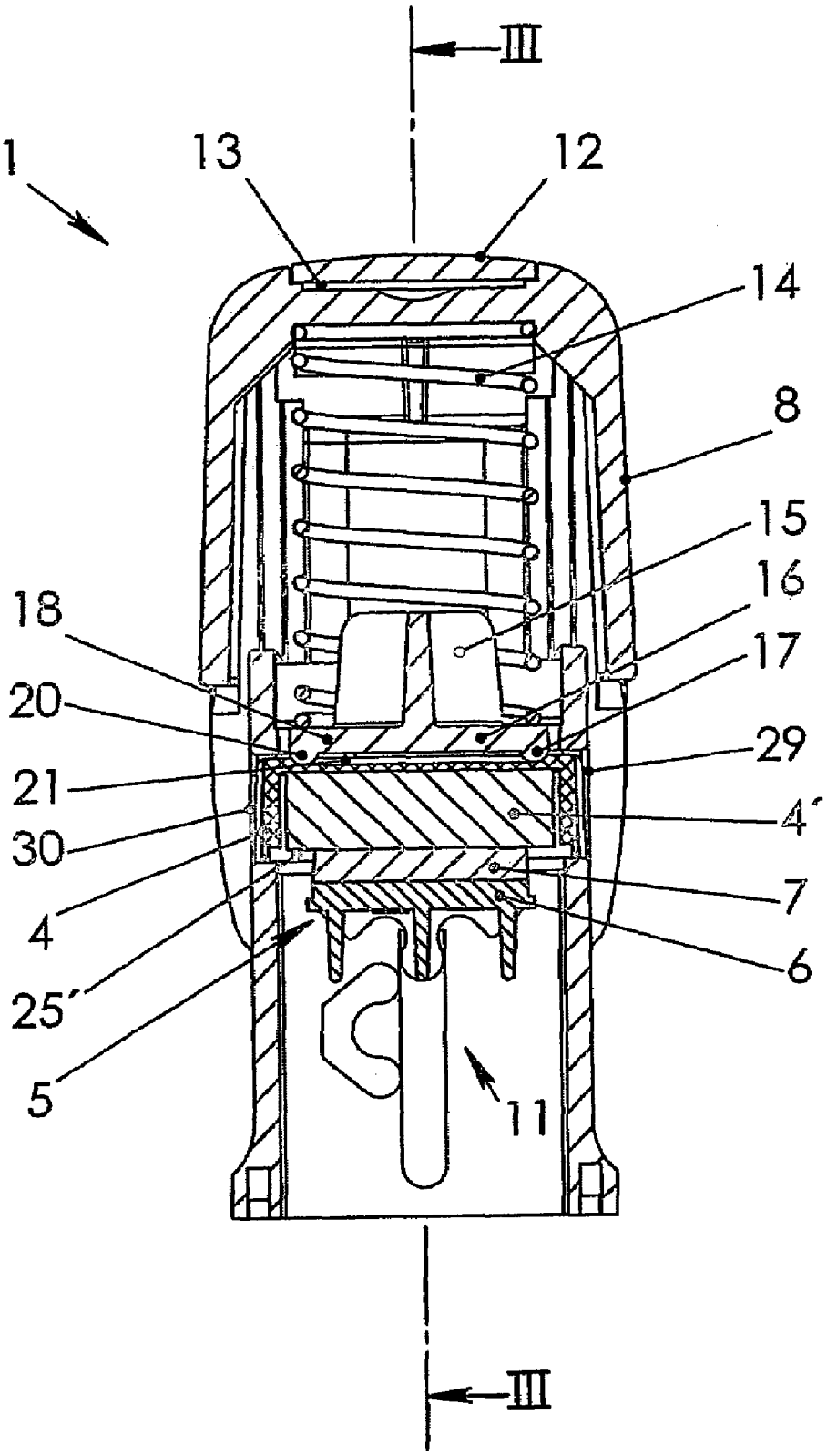
FIG. 2 shows a section through this self-inking stamp according to line II-II of FIG. 1.
Figure 3:
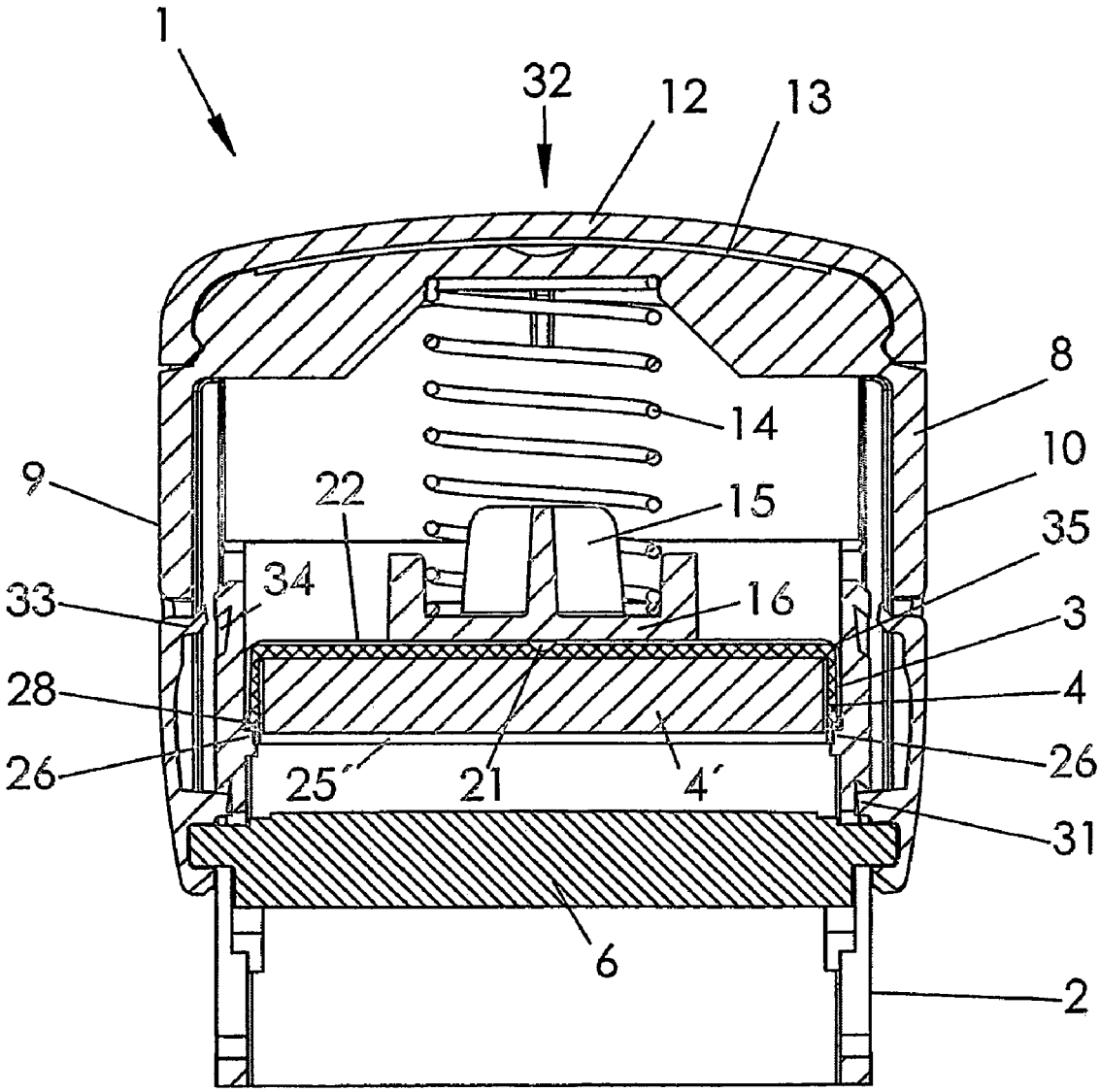
FIG. 3 shows a section through the self-inking stamp according to line III-III of FIG. 2, yet in an intermediate position with slightly pressed-down actuating bow and without stamping plate.
Figure 4:
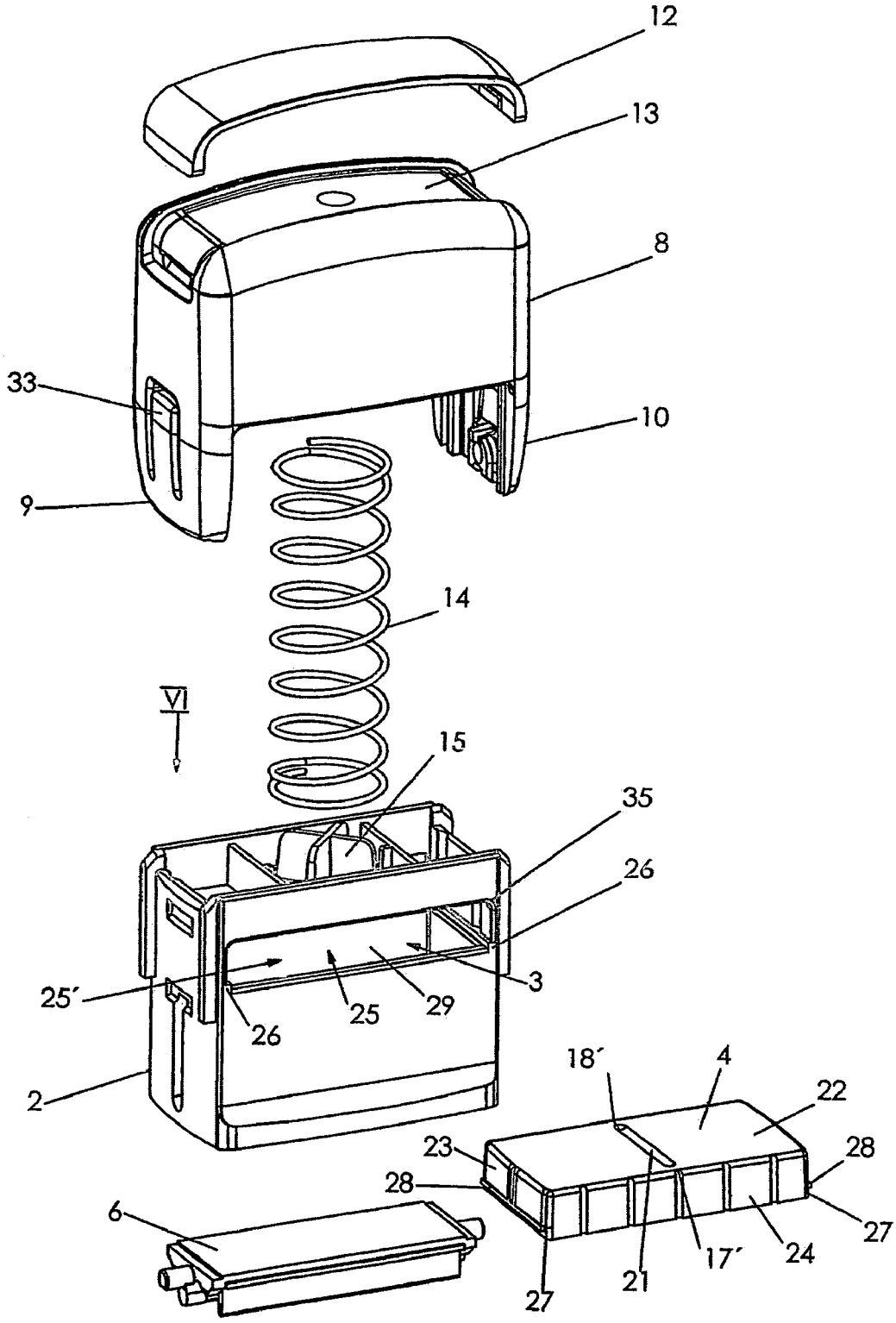
FIGS. 4 and 5 show the essential parts of this self-inking stamp in an exploded view, i.e. in a perspective view once seen from the front and once seen from the front lower side.

On its lower side 25, the insertion compartment 3 has an opening 25', cf. FIGS. 2, 3 and 4, for the passage of the stamp characters 7, and on the two narrow sides of the housing 2, this opening 25' is delimited by e.g. ledge-shaped guiding and centering projections 26. During insertion and removal as well as in the inserted operating position, cf. in particular FIGS. 1 and 3, the ink pad container 4 contacts these guiding and centering projections 26, the ink pad container 4 having corresponding recesses 27 on its narrow sides 23 (cf. FIG. 4) in the region of its lower rim. Just like the guiding and centering projections 26, these recesses 27 are designed to be continuous, and by the engagement of the guiding and centering projections 26 in the recesses 27, the exact position of the ink pad container 4 in its inserted state is defined, the ink pad container 4 optionally is pressed into this position by the resilient retention elements 17, 18 if they, too, press against the upper side of the container 4 in the region of the groove 21 in their operating position. According to FIGS. 3, 4 and 5, the recesses 27 are delimited by ledge projections 28 on their upper sides. Upwards of these ledge projections 28, the walls 23 on the narrow sides of the ink pad container 4 stand back again, so that in this region the ink pad container 4 possibly can be inserted in and removed from the insertion compartment 3 without any friction.

As also is visible in FIG. 2, the insertion compartment 3 is provided with insertion openings 29 and 30, respectively, both on the front side and on the rear side of the housing 2 so that the ink pad container 4 can be inserted in the housing 2 into the insertion compartment 3 thereof from either side and also can be pushed out of the insertion compartment 3 towards either side.

When inserting the ink pad container 4 in the insertion compartment 3, at first a resistance has to be overcome which is caused by the end wall which is the front end wall during this insertion, e.g. 18' according to the illustration in FIG. 4, this end wall 18' causing an upward lifting of the first resilient retention element, e.g. 17, contrary to the resilience. This counter-resilience is caused by the material elasticity of the retention elements 17, 18 as well as by the resilience of the spring 14 of the actuating part, which spring 14 is kept compressed between the wall 16 and the upper side of the actuating part 8 (cf. FIGS. 2 and 3). In the final phase of the insertion of the ink pad container 4 in the insertion compartment 3, such a resistance must once more be overcome, i.e. now because the end wall 17' which is the rear end wall during insertion is passed by the associated snap projection 20 on the front retention element 17. During a removal, temporary resistances will occur in a similar way, wherein the resilience of the retention elements 17, 18, when overcoming these resistances, due to the wedge-effect causes a force component on the ink pad container 4 in the removal direction so that the ink pad container 4 is "shot forward" by a certain extent (similar effects occur when inserting the ink pad container 4 in the insertion compartment 3).

Figure 5:
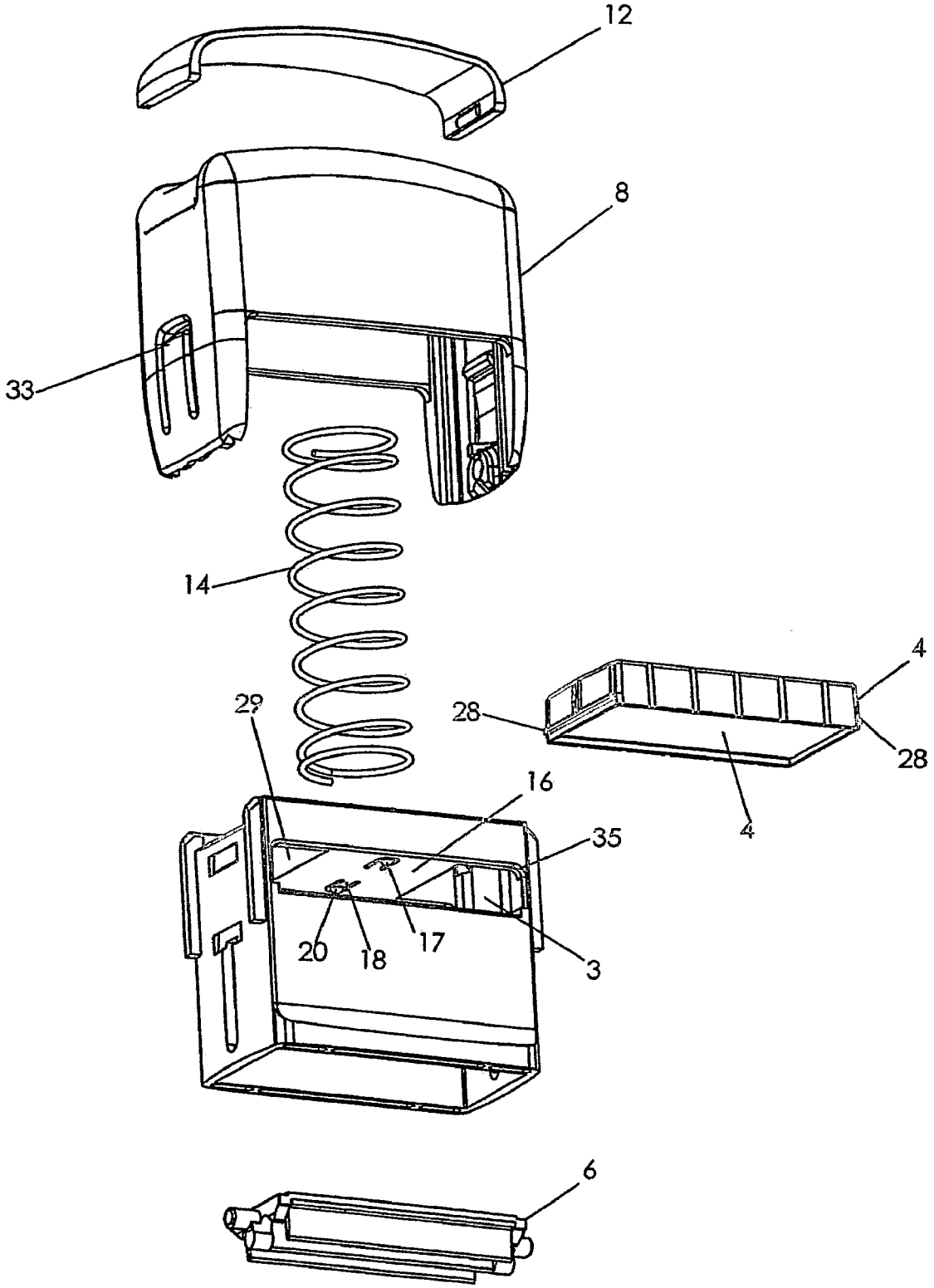
Figure 6:
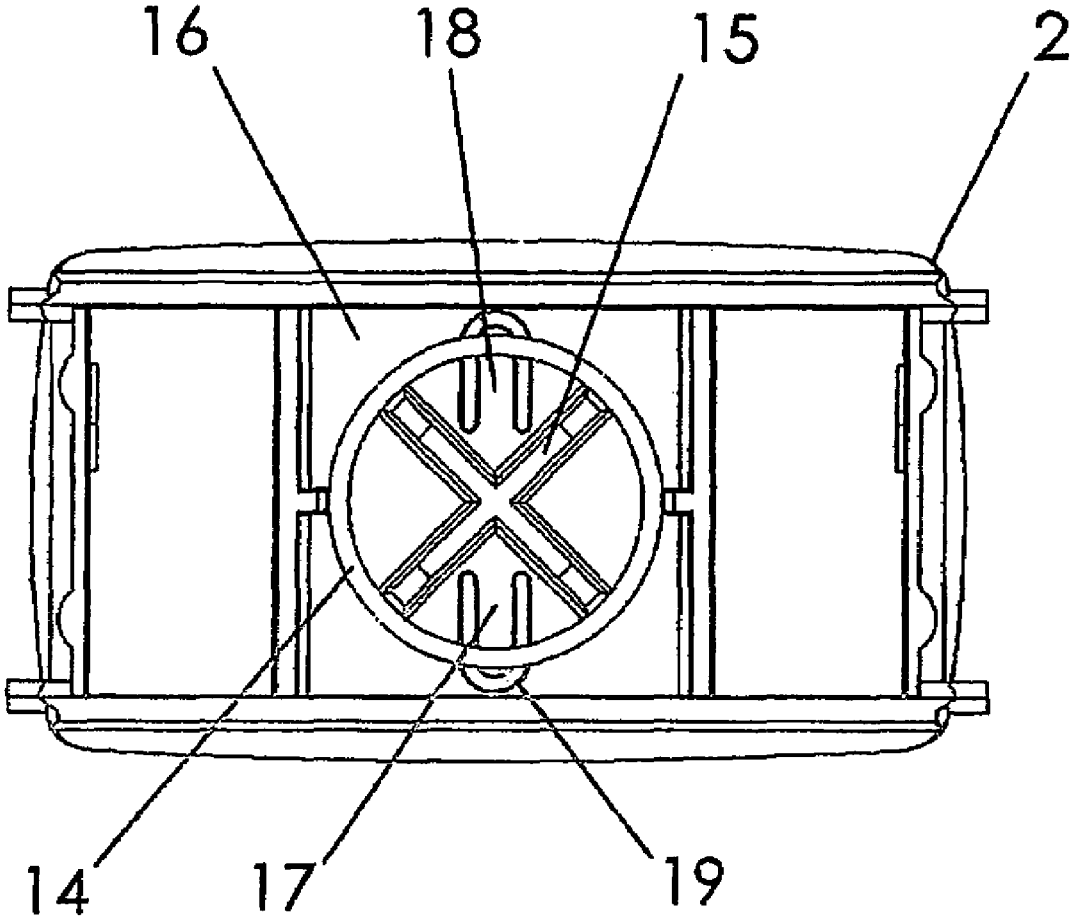
FIG. 6 shows a top view onto the upper side of the housing of the self-inking stamp, substantially according to arrow VI of FIG. 4.

From FIGS. 2, 3 and 5, furthermore the ink pad 4' contained in the ink pad container 4 can be seen.

Of course, the actuating part 8 with its legs 9, 10 is snapped over the side walls of the housing 2 in the assembled position of the self-inking stamp 1, cf. the detents 31 in FIG. 3, so that it will be retained on the housing 2 despite the force of the spring 14. Moreover, in FIG. 3 the actuating bow 8 is illustrated in a somewhat depressed (cf. arrow 32) intermediate position, viewed relative to the housing 2, wherein it can be snapped in in this intermediate position in hook-like manner by means of snap-in elements 33 (cf. also FIGS. 4 and 5 in addition to FIG. 3) in a per se conventional manner on corresponding detents 34 of the housing 2. In this intermediate position, it is possible to remove—or insert—the ink pad container 4, since in this position the stamp plate carrier 6 together with the stamp plate (7 in FIG. 2) which is not shown in FIG. 3 are located in a position spaced from the ink pad 4', whereas in the resting position illustrated in FIGS. 1 and 2 the stamp plate 7 contacts the lower side of the ink pad 4'.

Furthermore, in FIG. 3 as well as in FIG. 1 it is visible that the ink pad container 4, in its position inserted within the insertion compartment 3, by means of its upper narrow-side edges, contacts rounded portions 35 in the upper corners of the insertion openings 29, 30 in the front and rear housing walls, respectively, this contact of the ink pad container 4 on the rounded portions 35 also assisting in the desired centering. The lower side of the wall 16 can also act to guide and assist the centering of the ink pad container 4, in particular during insertion of the ink pad container 4, as particularly results from FIG. 3. Below the rounded portions 35 and above the ledges 26, the ink pad container 4 is provided spaced from the side wall of the housing 2, as can also be recognized from FIG. 3.

The individual parts of the self-inking stamp 1 described, i.e. in particular the housing 2, the actuating part 8, the inspection window 12 as well as the stamp plate carrier 6 and also the container 4 for the ink pad 29 preferably are made in a per se conventional manner of plastics, such as, e.g., ABS or POM.

As a variant of the exemplary embodiment illustrated, it would, e.g., also be conceivable to let the retention elements 17, 18 simply contact, under pressure, the upper side of a container bottom 22 designed without a depression (i.e. groove 21), thereby providing a frictional engagement instead of the snap-action described in order to retain the container 4 in the insertion compartment 3. Since the guiding and centering effect can be achieved with exactness by the ledge projections 26 and the recesses 27, it is, furthermore, also possible to design the entire bottom 22 of the container 4 depressed instead of providing the groove 21 as a depression, i.e. to provide only a peripherally extending, raised rim having an effect similar to that of the end walls 17', 18'. Furthermore, it would be conceivable to centrally arrange only one single resilient retention element, and in that case it would also be possible to configure this retention element as a resilient snap element with a central, spherical or knob-shaped snap-in projection which can snap into a corresponding spherical calotte-shaped snap-in depression in the bottom 22 of the container 4.

Figure 8:
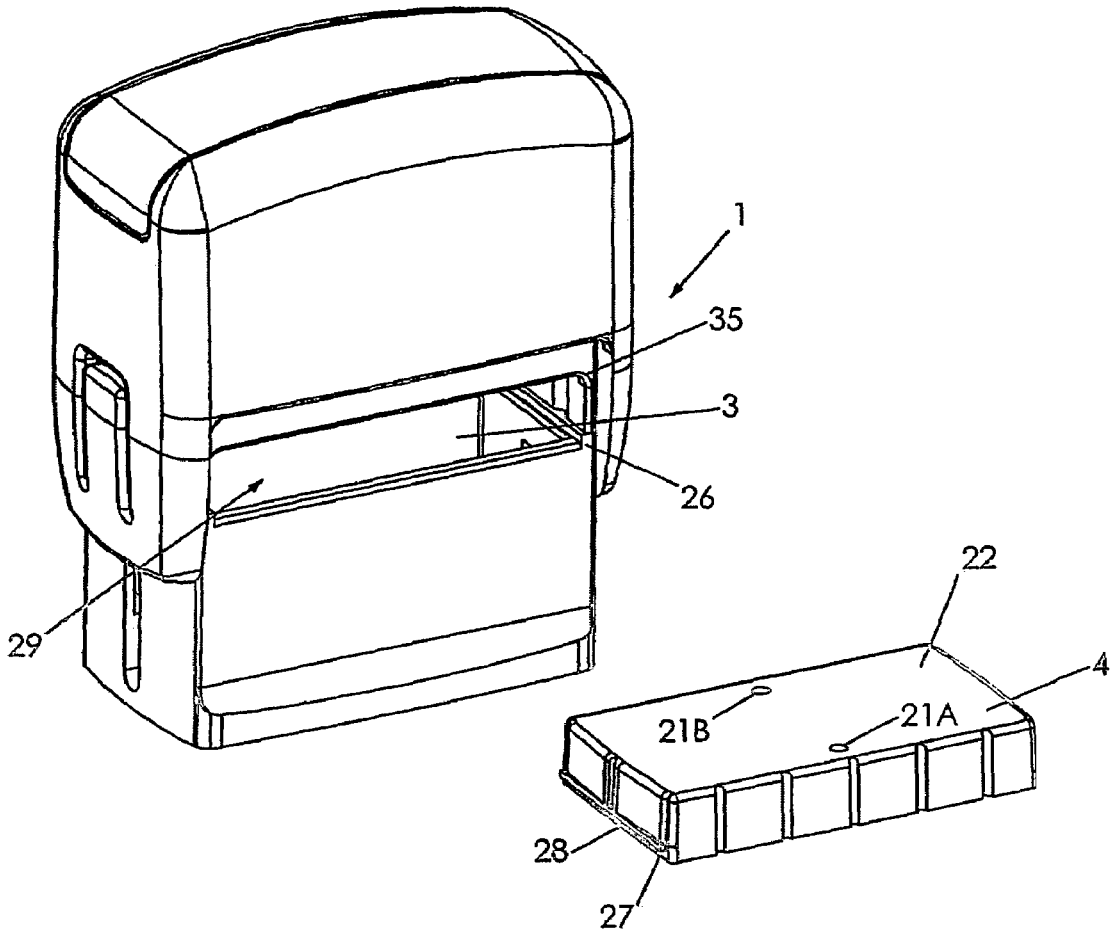
FIG. 8 shows a self-inking stamp with a modified ink-pad container in an exploded illustration.

Finally, in FIG. 8 a self-inking stamp 1 basically as described before, yet with an empty insertion compartment 3 as well as with an ink pad container 4 located in front thereof is illustrated, in whose bottom 22, instead of the previously described groove depression 21, two semi-spherical snap-in depressions 21A, 21B are provided in which the knob-shaped snap-in projections 20 snap in as described before by way of FIGS. 2, 5 and 7, when the ink pad container 4 is inserted in the insertion compartment 3. Also in this manner, a secure hold with centering of the ink pad container 4 is achieved, a type of "clicking in" of the ink pad container 4 occurring when inserting the ink pad container 4 into the insertion compartment 3. Otherwise, the embodiment of the self-inking stamp 1 according to FIG. 8 corresponds to that of FIGS. 1 to 7 so that it is not necessary to explain it anew.

The ledge-shaped guiding and centering projections 26 may also be discontinuous instead of the continuous design illustrated, and the cross-sectional shape of these projections 26 may also be of a design other than the rectangular one illustrated, such as a quarter-circular shape.

Accordingly, while only a few embodiments of the present invention have been shown and described, it is obvious that many changes and modifications may be made thereunto without departing from the spirit and scope of the invention.

What is claimed is:

1. An ink pad container to be used in a self-inking stamp, said ink pad container having a rectangular shape when seen in a plan view so that said ink pad container has two short sides and two long sides, and comprising a bottom, and two opposing short side walls and two opposing long side walls, all of said side walls projecting away from said bottom, wherein each of said short side walls comprises a ledge projecting away from a region of a lower edge of said short side walls, said ledge being located near said bottom and extending parallel to said bottom, said ledges extending along a length of said short side walls and defining together with said side walls step-like recesses for cooperating with continuous guiding and centering projections in an insertion compartment of the self-inking stamp to define precise guiding and centering of the ink pad container during its insertion, wherein the bottom is designed with a depression provided for snapping engagement of a resilient retention element provided in the insertion compartment of the self-inking stamp.

2. The ink pad container according to claim 1, wherein the depression is formed by a groove extending in the direction of insertion of the ink pad container.

3. The ink pad container according to claim 2, wherein the depression is delimited on both ends by an end wall.

4. The ink pad container according to claim 3, wherein the depression is provided centrally in the bottom.

* * * * *